US007294239B2

(12) United States Patent
Lomic et al.

(10) Patent No.: US 7,294,239 B2
(45) Date of Patent: Nov. 13, 2007

(54) METHOD AND AN APPARATUS FOR MANUFACTURING AND DRYING A FIBER WEB PROVIDED WITH A THREE-DIMENSIONAL SURFACE STRUCTURE

(75) Inventors: Stefan Lomic, Vienna (AT); Jeffrey Herman, Bala Cynwyd, PA (US); Thomas Thoröe Scherb, Sao Paulo (BR)

(73) Assignee: Voith Paper Patent GmbH, Heidenheim (DE)

( * ) Notice: Subject to any disclaimer, the term of this patent is extended or adjusted under 35 U.S.C. 154(b) by 367 days.

(21) Appl. No.: 10/768,482

(22) Filed: Jan. 30, 2004

(65) Prior Publication Data

US 2005/0166418 A1 Aug. 4, 2005

(51) Int. Cl.
*D21F 5/00* (2006.01)

(52) U.S. Cl. ..... 162/375; 34/117; 34/119; 34/123; 34/124; 162/109; 162/111; 162/207; 162/289; 162/290; 162/357; 162/359

(58) Field of Classification Search ..... 162/375, 162/109, 111, 113, 204, 205, 206, 289, 290, 162/357; 34/117, 119, 123, 124
See application file for complete search history.

(56) References Cited

U.S. PATENT DOCUMENTS 3,354,035 A * 11/1967 Gottwald et al. ..... 162/206
5,722,182 A 3/1998 Lehtinen et al. ..... 34/418
5,799,409 A * 9/1998 Chau-Huu et al. ..... 34/117
6,139,686 A 10/2000 Trokhan et al. ..... 162/109
6,189,233 B1 2/2001 Halmschlager et al. ..... 34/117
6,294,050 B1 * 9/2001 Oechsle et al. ..... 162/207
6,855,227 B2 * 2/2005 Beck ..... 162/109
2004/0237210 A1 12/2004 Thoroe-Scherb et al. .. 8/115.51

FOREIGN PATENT DOCUMENTS

WO WO 99/47749 9/1999
WO WO 01/18307 3/2001
WO 03/008706 1/2003

* cited by examiner

*Primary Examiner*—Mark Halpern
(74) *Attorney, Agent, or Firm*—Taylor & Aust. P.C.

(57) ABSTRACT

An apparatus for dewatering a fiber web in a paper machine includes a heated drying surface, a permeable fabric carrying the fiber web, and a condensing region adjacent a portion of the permeable fabric on a side opposite the fiber web. The fiber web is interposed between and contacts each of the heated drying surface and the permeable fabric. The condensation region has: a) a temperature which is less than a temperature of the permeable fabric; and/or b) a pressure which is greater than an ambient pressure.

19 Claims, 2 Drawing Sheets

METHOD AND AN APPARATUS FOR MANUFACTURING AND DRYING A FIBER WEB PROVIDED WITH A THREE-DIMENSIONAL SURFACE STRUCTURE

BACKGROUND OF THE INVENTION

1. Field of the Invention

The invention relates to a method and to an apparatus for manufacturing a fiber web, in particular a web of tissue or hygiene material, provided with a three-dimensional surface structure. It further relates to a method and an apparatus for drying a fiber web, in particular a web of tissue or hygiene material.

2. Description of the Related Art

The imprinting of a three-dimensional structure into the surface of a paper web, in particular of a tissue web, in particular of hand tissue, is known (see, for example, WO 99/47749, WO 01/18307). It is further known that a very good paper quality can be achieved by so-called through-air drying (TAD). However, it is disadvantageous that the use of TAD dryers is very complex and correspondingly expensive.

SUMMARY OF THE INVENTION

The present invention provides an improved method and an improved apparatus of the kind initially mentioned with which in particular a high quality of the end product can be achieved in an economic and correspondingly favorably priced manner even without the use of a larger TAD drying apparatus. In this connection, a corresponding quality should be reached in particular with respect to the water retention capability, the water absorption rate, the bulk, etc.

The present invention provides an additional drying device positioned upstream from a drying cylinder. The additional drying device includes a drying surface which evaporates moisture in the fiber web, and a condensation region with an associated higher pressure and/or colder temperature.

The invention comprises, in one form thereof, an apparatus for dewatering a fiber web in a paper machine, including a heated drying surface, a permeable fabric carrying the fiber web, and a condensing region adjacent a portion of the permeable fabric on a side opposite the fiber web. The fiber web is interposed between and contacts each of the heated drying surface and the permeable fabric. The condensation region has: a) a temperature which is less than a temperature of the permeable fabric; and/or b) a pressure which is greater than an ambient pressure.

The invention comprises, in another form thereof, a method of dewatering a fiber web, including the steps of: carrying the fiber web with a permeable fabric to a heated drying surface; contacting the fiber web on one side with the heated drying surface and on an other side with the permeable fabric; evaporating moisture in the fiber web using heat from the heated drying surface; and condensing the evaporated moisture in a condensing fabric on a side of the permeable fabric opposite the fiber web, the condensing fabric having: a) a temperature which is less than a temperature of the permeable fabric, and/or b) a pressure which is greater than an ambient pressure.

An advantage of the present invention is that the moisture content of the fiber web is reduced by evaporation using the heated drying surface of the additional drying device.

Another advantage is that the evaporated moisture is condensed in a region away from the permeable fabric using a higher pressure and/or lower temperature for subsequent removal.

Yet another advantage is that the fiber web is drawn into the coarse permeable fabric prior to pressing so that the physical properties of the fiber web are not substantially adversely affected by the pressure in the "knuckle areas".

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
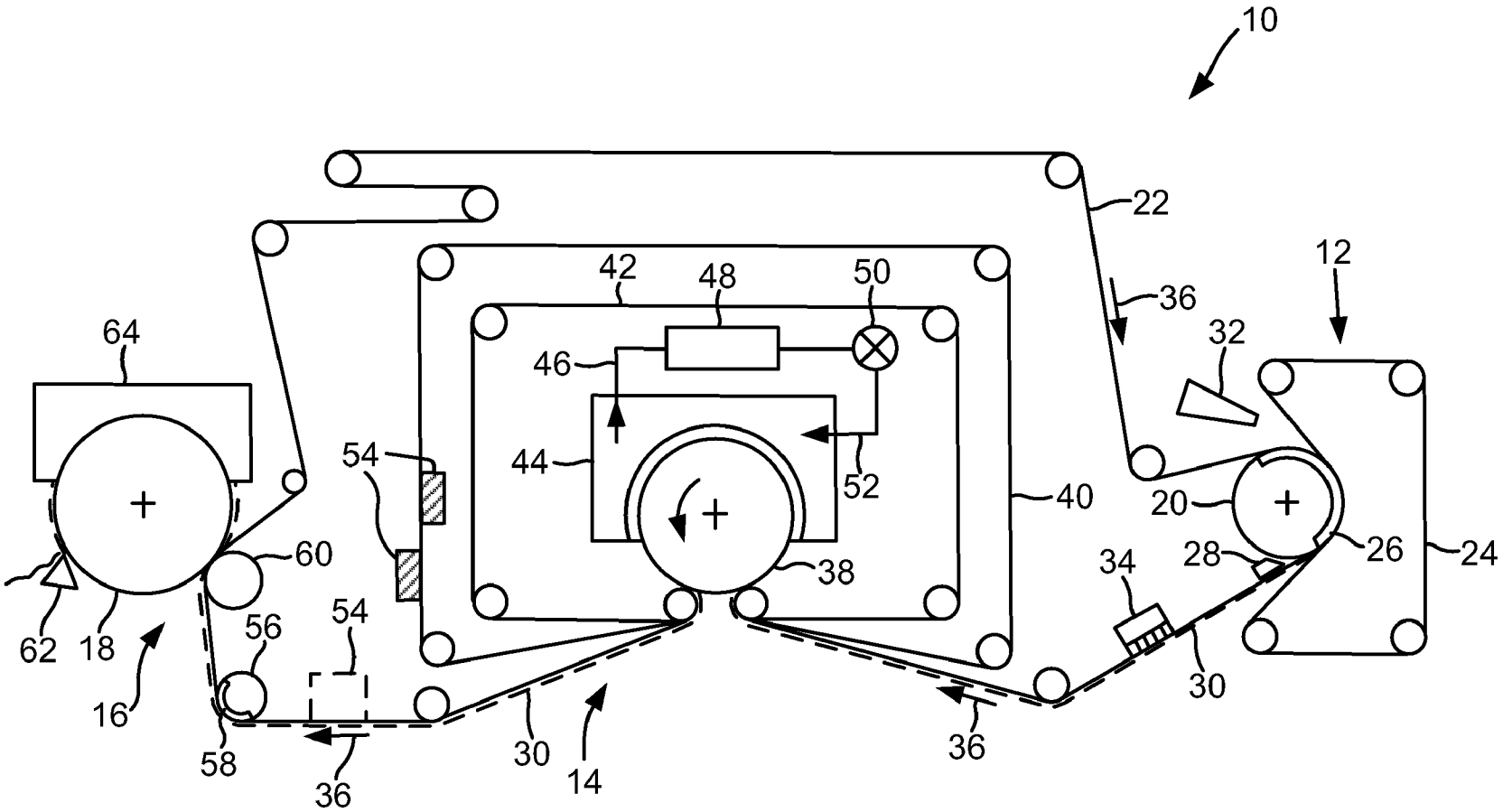
FIG. 1 is a schematic illustration of an embodiment of a paper machine of the present invention.

Referring now to the drawings, and more particularly to FIG. 1, there is shown an embodiment of a paper machine 10 of the present invention, which generally includes a double wire forming section 12, a drying device 14, and a press assembly 16 including a drying cylinder 18.

In the embodiment shown, double wire forming section 12 is a crescent former type forming section including a forming roll 20 carrying a permeable fabric 22 (instead of a conventional felt) and an outer forming wire 24 around a portion of the periphery thereof. Forming roll 20 may include an optional suction zone 26. Suction device 28 is positioned at the downstream side of the extended nip formed between permeable fabric 22 and outer forming wire 24 and separates fiber web 30 from outer forming wire 24. Fiber web 30 may be of any suitable type, such as a paper web or more particularly a tissue web. Wire forming section 12 receives fiber suspension from head box 32, which forms fiber web 30.

Permeable fabric 22 is a coarse permeable fabric, such as a structured permeable fabric forming a structured three-dimensional fiber web. In one embodiment, permeable fabric 22 is configured as a through air drying fabric allowing air or another gaseous medium to flow therethrough.

A wet suction box 34 is positioned adjacent to and in fluid communication with a portion of permeable fabric 22. Wet suction box 34 is positioned between double wire forming section 12 and drying device 14 relative to the fiber web travel direction 36.

Drying device 14 includes a heated drying surface 38, which is in the form of a heated drying cylinder in the embodiment shown. Drying device 14 is internally referred to as a "Boost Dryer" within the assignee of the present invention. Drying cylinder 38 has a surface temperature of between approximately 100° C. to 250° C.; and more particularly has a surface temperature of between approximately 120° C. to 180° C.; This surface temperature range has been found to be effective to evaporate a portion of the moisture within fiber web 30 carried by drying cylinder 38.

A condensation fabric 40 is positioned adjacent to permeable fabric 22 on a side opposite fiber web 30. Condensation fabric 40 is a permeable fabric allowing the evaporated moisture to accumulate and condense therein, as will be described in more detail hereinafter. An impermeable membrane 42 is positioned adjacent to condensation fabric 40 on a side opposite permeable fabric 22. Impermeable membrane 42 allows pressure to be applied to condensation fabric 40, permeable fabric 42 and fiber web 30, and also is thermally conductive.

Drying device 14 also includes a pressurized hood 44 which surrounds and is substantially sealed with a portion of drying cylinder 38. Pressurized hood 44 is in communication with a plurality of outlets 46, one of which is visible in FIG. 1, which in turn are fluidly coupled with a header 48. Header 48 is coupled on the discharge side thereof with a pump 50, which in turn pressurizes the circulating fluid medium (e.g., pressurized steam, water, air or other gas) and discharges the pressurized fluid medium to one or more inlets 52 in communication with pressurized hood 44. Pressurizing the fluid medium using pump 50 not only increases the pressure of the fluid medium to a pressure greater than ambient pressure, but also reduces the temperature of the fluid medium. In one embodiment, the fluid medium circulated within pressurized hood 44 is pressurized to a pressure of between approximately $0.5\times10^5$ N/m$^2$ and $1\times10^6$N/m$^2$.

Water which is condensed within the pores of condensation fabric 40 is removed from condensation fabric 40 by conditioners/suction device 54 positioned on opposite sides of condensation fabric 40 in the return loop after exiting from the discharge side of drying cylinder 38.

Fiber web 30 exits drying device 14 and is carried from drying device 14 on the bottom side of permeable fabric 22. Optional cooling device 55 is positioned adjacent permeable fabric 22 on a side opposite from fiber web 30.

Positioned downstream from cooling device 55 is turning roll 56 located adjacent permeable fabric 22 on a side opposite from fiber web 30. Turning roll 56 is positioned between drying device 14 and press assembly 16 relative to fiber web travel direction 36. Turning roll 56 is in the form of a suction turning roll with a suction zone 58 in the embodiment shown in FIG. 1.

An additional suction box (not shown) can be positioned upstream from turning roll 56, between turning roll 56 and drying device 14.

Press assembly 16 includes press member 60 defining a press nip with drying cylinder 18. In the embodiment shown, press member 60 is in the form of a suction press roll, but may also be configured differently, such as a shoe press roll, etc. Fiber web 30 and permeable fabric 22 travel through the press nip between press member 60 and drying cylinder 18. Fiber web 30 is immediately adjacent to drying cylinder 18, and permeable fabric 22 is immediately adjacent to press member 60. Drying cylinder 18 and press member 16 are each positioned downstream from drying device 14 relative to web travel direction 36.

Drying cylinder 18 preferably is configured as a Yankee drying cylinder having a large diameter and corresponding large circumference. Drying cylinder 18 thus provides the dual functionality of both acting as a drying cylinder and being used as part of press assembly 16. A creping doctor 62 is positioned on the downstream side of drying cylinder 18.

A hot air drying hood 64 is positioned adjacent to and partially surrounds drying cylinder 18. Hot air drying hood 64 thus is in fluid communication with permeable fabric 22 and fiber web 30. Hot air drying hood 64 further assists in drying of fiber web 30 as it is carried about the periphery of drying cylinder 18.

Using a paper machine 10 as shown in FIG. 1, a paper web, especially a tissue web, is dried prior to drying cylinder 18 by evaporating a part of the water in fiber web 30 at a pressure which is higher than the ambient pressure. During the drying process, fiber web 30 is in contact with a heated drying surface 38 (e.g., drying cylinder). The other side of fiber web 30 is in contact with and is transported by thin, permeable fabric 22. The water vapor passes through permeable fabric 22 and condenses in the colder condensation fabric 40. Pressure is provided by pressurized hood 44. Paper machine 10 is capable of producing a bulky tissue with a high water capacity (kg water/kg fiber). The structure of fiber web 30 is provided by forming or by suctioning wet fiber web 30 into the coarse fabric structure of permeable fabric 22 using suction box 34. This formed structure of fiber web 30 is not destroyed by the high efficiency drying process using paper machine 10. The drying rate of drying device 14 is above 400 kg/hrm$^2$ and preferably above 500 kg/hrm$^2$.

The sheet absorbency capacity as measured by the basket method, for a nominal 20 gsm web is equal to or greater than 12 grams water per gram of fiber and often exceeds 15 grams of water per gram fiber. The sheet bulk is equal to or greater than 10 cm$^3$/gm and preferably greater than 13 cm$^3$/gm. The sheet bulk of toilet tissue is expected to be equal to or greater than 13 cm$^3$/gm before calendering.

With the basket method of measuring absorbency, five (5) grams of paper are placed into a basket. The basket containing the paper is then weighted and introduced into a small vessel of water at 20° C. for 60 seconds. After 60 seconds of soak time, the basket is removed from the water and allowed to drain for 60 seconds and then weighted again. The weight difference is then divided by the paper weight to yield the grams of water held per gram of fibers being absorbed and held in the paper.

More particularly, during use, head box 32 discharges a fiber suspension into the forming section between permeable fabric 22 and outer forming wire 24. Fiber web 30 is suctioned using wet suction box 34 to control sheet moisture. Fiber web 30 is then dried in drying device 14 and is transferred to the press nip between two press members. One press member is Yankee cylinder 18 and the other press member is a press roll 60, such as a suction press roll or preferably a shoe press roll. The press nip can be preceded by suction turning roll 56 and/or cooling device 55. Fiber web 30 is then dried using Yankee cylinder 18, preferably also with hot air drying hood 64, and is creped by doctor 62.

Pressurized hood 44 is pressurized by a hot fluid, e.g., pressurized steam or water. The temperature of fluid medium in pressurized hood 44 is less than the temperature of heated drying cylinder 38. The condensed water in condensation fabric 40 is suctioned out by suction boxes 54. Impermeable membrane 42 fluidly separates the fluid in pressurized hood 44 from condensation fabric 40.

Figure 2:
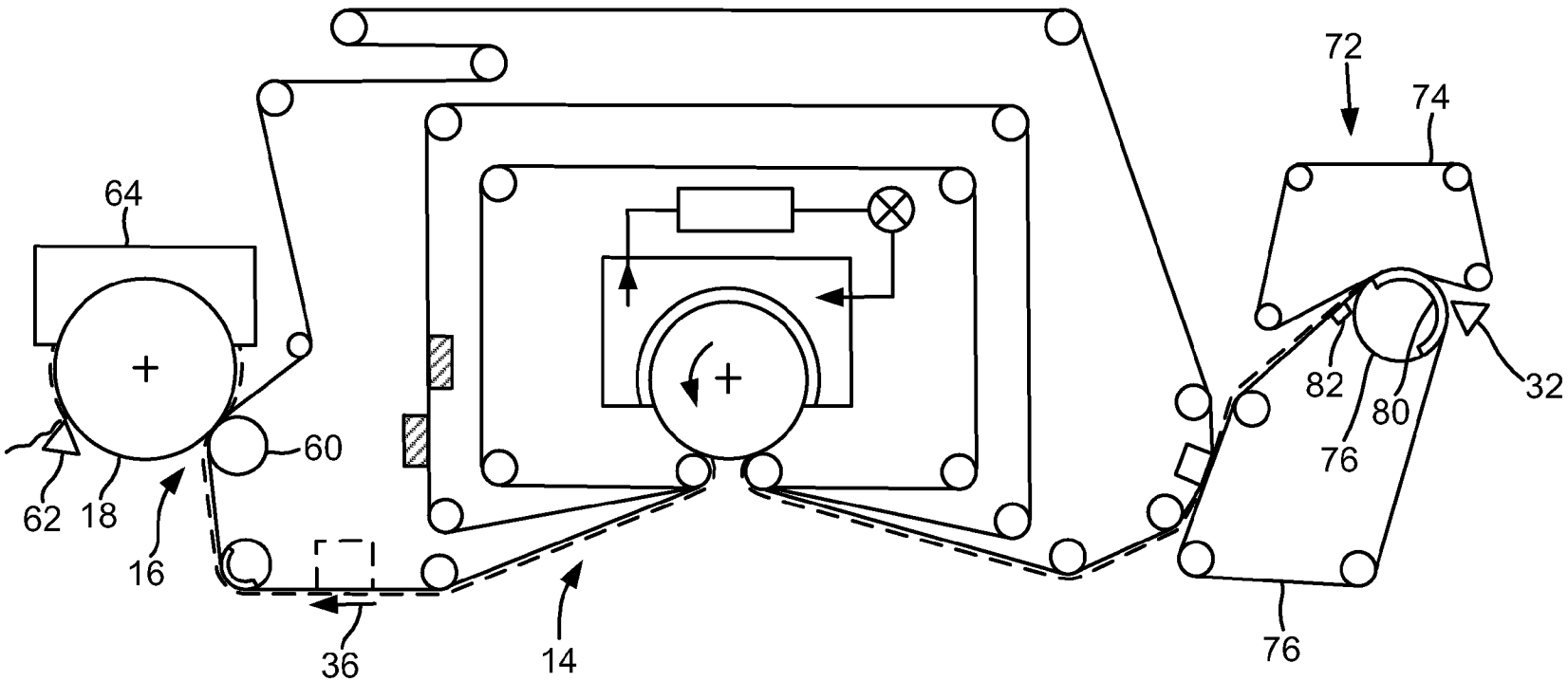
FIG. 2 is a schematic illustration of another embodiment of a paper machine of the present invention.

FIG. 2 illustrates yet another embodiment of a paper machine 70 of the present invention. Paper machine 70 generally includes a double wire forming section 72, drying device 14, and press nip 16 defined by drying cylinder 18 and press roll 60. It will be readily apparent upon comparison of FIG. 2 with FIG. 1 that the primary difference between paper machines 10 and 70 is the configuration of double wire forming section 72 with respect to double wire forming section 12 shown in FIG. 1. Particularly, in the embodiment shown in FIG. 2, double wire forming section 72 is in the form of a twin wire former including an upper wire 74 and a lower wire 76. Forming roll 78 includes a suction zone 80 similar to forming roll 20 shown in FIG. 1. Double wire forming section 72 also includes a suction device 82 positioned immediately downstream from forming roll 78. The structure and operation of paper machine 70 otherwise is similar to that of paper machine 10 described above, and thus will not be described in further detail.

It is also possible to configure the double wire forming section as a fourdrinier wire former or an inclined wire former (not shown).

According to the embodiments of paper machines 10 and 70 shown in FIGS. 1 and 2, drying device 14 is positioned upstream from a further drying cylinder in the form of a Yankee cylinder 18. However, it is also possible in another embodiment (not shown) to increase the diameter of drying cylinder 38 such that fiber web 30 has a longer contact path around the periphery of drying cylinder 38. This increases the drying effectiveness of drying cylinder 38, and allows Yankee cylinder 18 to be eliminated in this embodiment.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for dewatering a fiber web in a paper machine, comprising:

a heated drying surface;

a permeable fabric carrying the fiber web, the fiber web being interposed between and contacting each of said heated drying surface and said permeable fabric;

a condensation fabric adjacent said permeable fabric on a side opposite the fiber web, said condensation fabric having a temperature which is less than a temperature of said permeable fabric; and an impermeable membrane being adjacent to said condensation fabric on a side opposite of said permeable fabric.

2. The dewatering apparatus of claim 1, wherein said heated drying surface comprises a drying cylinder.

3. The dewatering apparatus of claim 1, wherein said heated drying surface has a surface temperature of between approximately 100° C. and 250° C.

4. The dewatering apparatus of claim 3, wherein said heated drying surface has a surface temperature of between approximately 120° C. and 180° C.

5. The dewatering apparatus of claim 1, wherein said permeable fabric is a coarse permeable fabric.

6. The dewatering apparatus of claim 5, wherein said permeable fabric is a coarse structured permeable fabric.

7. The dewatering apparatus of claim 5, wherein said permeable fabric is a through air drying fabric.

8. The dewatering apparatus of claim 1, further including a pressurized hood adjacent and in fluid communication with a portion of said condensation fabric, said pressurized hood having a pressurized fluid therein at a pressure greater than an ambient pressure.

9. The dewatering apparatus of claim 8, wherein said impermeable membrane is positioned between said pressurized hood and said condensation fabric.

10. The dewatering apparatus of claim 8, wherein said pressure within said pressurized hood is between approximately $0.5\times10^5$ N/m$^2$ and $1\times10^6$ N/m$^2$.

11. The dewatering apparatus of claim 8, wherein said fluid within said pressurized hood is colder than or equal to approximately 80° C.

12. The dewatering apparatus of claim 1, further including a drying cylinder and a press member defining a press nip therebetween, the fiber web and said permeable fabric traveling through said press nip, the fiber web being adjacent said drying cylinder, said drying cylinder and said press member positioned downstream from said heated drying surface relative to a direction of travel of the fiber web.

13. The dewatering apparatus of claim 12, wherein said press member comprises one of a shoe press roll and a suction press roll.

14. The dewatering apparatus of claim 12, further including a hot air drying hood adjacent and in fluid communication with a portion of said drying cylinder.

15. The dewatering apparatus of claim 12, further including a turning roll in contact with said permeable fabric, said turning roll positioned between said heated drying surface and said drying cylinder relative to the fiber web travel direction.

16. The dewatering apparatus of claim 15, wherein said turning roll comprises a suction turning roll.

17. The dewatering apparatus of claim 1, further including a double wire forming section positioned upstream from said heated drying surface relative to a direction of travel of the fiber web.

18. The dewatering apparatus of claim 17, wherein said double wire forming section comprises one of a twin wire former, a crescent former, a fourdrinier wire former, and an inclined wire former.

19. The dewatering apparatus of claim 17, further including a wet suction box adjacent and in fluid communication with a portion of said permeable fabric, said wet suction box positioned between said double wire forming section and said heated drying surface relative to the fiber web travel direction.

* * * * *